United States Patent [19]

Fukuhara et al.

[11] Patent Number: 4,531,227

[45] Date of Patent: Jul. 23, 1985

[54] ROTARY ANODE FOR X-RAY TUBE

[75] Inventors: Yoshio Fukuhara, Yokohama; Hideo Koizumi, Tokyo, both of Japan

[73] Assignee: Tokyo Shibaura Denki Kabushiki Kaisha, Japan

[21] Appl. No.: 422,178

[22] Filed: Sep. 23, 1982

[30] Foreign Application Priority Data

Sep. 30, 1981 [JP] Japan ..... 56-155498

[51] Int. Cl.[3] ..... H01J 35/10

[52] U.S. Cl. ..... 378/144; 378/125

[58] Field of Search ..... 378/125, 144

[56] References Cited

U.S. PATENT DOCUMENTS

| | | | |
|---|---|---|---|
| Re. 31,560 | 4/1984 | Devine, Jr. | 378/144 |
| 3,579,022 | 5/1971 | Hennig et al. | 378/125 |
| 3,751,702 | 8/1973 | Dietz | 378/144 |
| 3,836,803 | 9/1974 | Dietz et al. | 378/144 |
| 3,836,804 | 9/1974 | Frens et al. | 378/144 |
| 4,132,917 | 1/1979 | Bildstein et al. | 378/144 |

FOREIGN PATENT DOCUMENTS

| | | |
|---|---|---|
| 1937351 | 2/1971 | Fed. Rep. of Germany . |
| 1951383 | 2/1974 | Fed. Rep. of Germany . |
| 2009538 | 5/1974 | Fed. Rep. of Germany . |

*Primary Examiner*—Alfred E. Smith
*Assistant Examiner*—T. N. Grigsby
*Attorney, Agent, or Firm*—Cushman, Darby & Cushman

[57] ABSTRACT

The invention provides a rotary anode which has a graphite body having a plurality of radial slits and a target layer adhered to the upper surface of the graphite body. The target layer is a single layer of tungsten or a tungsten alloy, or a composite layer consisting of the single layer and a molybdenum layer. In the manufacturing process and in use of the rotary anode, a thermal stress which occurs in the graphite body is decreased, thus preventing cracking of the graphite body. The invention also provides a method for manufacturing the rotary anode.

8 Claims, 7 Drawing Figures

ROTARY ANODE FOR X-RAY TUBE

BACKGROUND OF THE INVENTION

The present invention relates to a rotary anode for an X-ray tube and a method for manufacturing the same.

A rotary anode for an X-ray tube which has a large thermal capacity and a high X-ray output has been widely used for X-ray tubes in the medical field.

Generally, a material of the rotary anode for generating X-rays by electron bombardment is selected from tungsten and a tungsten alloy which have excellent resistance to a great amount of heat generated as a by-product when the X-rays are generated. Furthermore, in order to improve a heat resistance, a rotary anode has been used in which a molybdenum layer which is thicker than a tungsten target layer is integrally formed as a heat absorbing layer on the rear surface of the target layer.

However, along with the development of X-ray techniques, a rotary anode is desired which has a greater thermal capacity and a greater resistance to either a spontaneous high load input or a continuous load.

In order to satisfy the above need, a rotary anode has been developed which comprises a graphite body which has a small specific gravity and a large heat-dissipating capacity, and a tungsten layer or a composite layer consisting of a molybdenum layer and a tungsten layer. The graphite body and the tungsten layer or the composite layer are adhered together, for example, by hot pressing. In the hot press process, the thermal expansion factor of tungsten is about $5\times10^{-6}$/deg., while that of graphite is about $2\times10^{-6}$/deg. Thus, their thermal expansion factors differ greatly, and distortion occurs in the cooling process at a vicinity of a junction between the graphite body and the target layer, resulting in cracking of the graphite body.

Even if the adhesion between the graphite body and the target layer is completely performed, the graphite body tends to be cracked by thermal stress due to high temperature when the rotary anode is mounted in the X-ray tube and receives heat by X-ray radiation.

SUMMARY OF THE INVENTION

It is an object of the present invention to provide a rotary anode for an X-ray tube and a method for manufacturing the same, wherein cracking of a graphite body may not occur during the manufacturing process or in the use thereof.

According to an aspect of the present invention, there is provided a rotary anode for an X-ray tube, comprising a graphite body which has a plurality of radial slits, preferably four or more, and has a target layer formed on an upper surface thereof.

The target layer comprises a member selected from the group consisting of a single layer of tungsten or a tungsten alloy, and a composite layer consisting of the single layer and a molybdenum layer.

The volume ratio of the graphite body to the target layer is preferably about 7 to 15:1. The width of the slits formed in the graphite body is preferably about 0.5 to 3 mm, more preferably about 0.6 to 1 mm.

According to another aspect of the present invention, there is provided a first method for manufacturing a rotary anode for an X-ray tube, comprising the steps of: radially dividing a graphite body into a plurality of segments along a plane which includes a rotating shaft of said graphite body; forming said segments into an integral body, and placing a target layer on an upper surface of said integral body; and performing hot pressing to adhere said integral body to said target layer.

According to still another aspect of the present invention, there is provided a first method for manufacturing a rotary anode for an X-ray tube, comprising the steps of: radially dividing a graphite body into a plurality of segments along a plane which includes a rotating shaft of said graphite body; sandwiching spacers between said segments so as to form said segments into an integral body, and placing a target layer on an upper surface of said integral body, each of said spacers having a predetermined width; performing hot pressing to adhere said integral body to said target layer; and removing said spacers.

According to still another aspect of the present invention, there is provided a second method for manufacturing a rotary anode for an X-ray tube, comprising the steps of: preparing a plurality of segments which together constitute a graphite body, said segments respectively having extended steps at upper portions thereof, so that a plurality of slits are formed beneath said extended steps when said graphite body is formed; arranging said segments to form an integral body which corresponds to said graphite body, and placing a target layer on said integral body; and performing hot pressing to adhere said integral body to said target layer.

According to still another aspect of the present invention, there is provided a third method for manufacturing a rotary anode for an X-ray tube, comprising the steps of: placing a target layer on an upper surface of a graphite body; performing hot pressing to adhere said graphite body to said target layer; and forming a plurality of radial slits in said graphite body.

According to still another aspect of the present invention, there is provided a fourth method for manufacturing a rotary anode for an X-ray tube, comprising the steps of: forming a plurality of radial slits except at upper and lower portions of a graphite body; placing a target layer on an upper surface of said graphite body having said plurality of radial slits and performing hot pressing to adhere said graphite body to said target layer; and removing said lower portion of said graphite body to expose said plurality of radial slits at a lower surface of said graphite body.

DETAILED DESCRIPTION OF THE PREFERRED EMBODIMENTS

A rotary anode for an X-ray tube according to an embodiment of the present invention will be described with reference to FIGS. 1 and 2.

Figure 1:
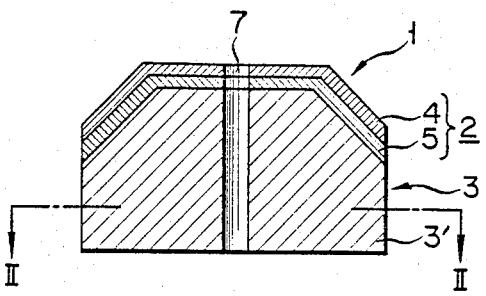
FIG. 1 is a vertical sectional view of a rotary anode for an X-ray tube according to an embodiment of the present invention.

Referring to FIG. 1, a rotary anode 1 comprises a frustoconical target layer 2 and a graphite body 3 which is adhered to the lower surface of the target layer 2. The target layer 2 is made of a tungsten layer 4 and a molybdenum layer 5, and a laminate body thereof is hot pressed such that the molybdenum layer 5 faces inside, and is formed in a frustoconical shape. As shown in FIG. 2, the graphite body 3 is radially divided into segments 3' (four in this embodiment) of the same size. Slits 6 are respectively formed between the segments 3'. The horizontal section of the graphite body is of a circular shape.

Figure 2:
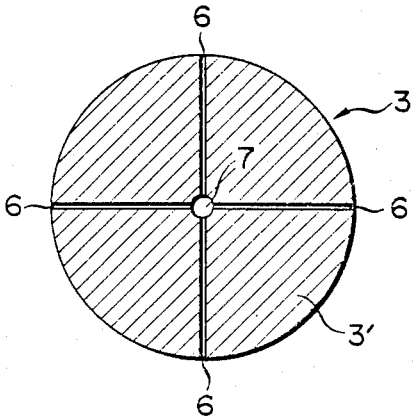
FIG. 2 is a horizontal sectional view of the rotary anode along the line II—II in FIG. 1.

Referring to FIGS. 1 and 2, reference numeral 7 denotes a bore hole for receiving the rotating shaft.

Figure 3:
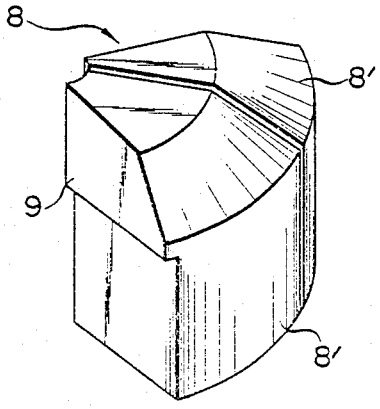
FIGS. 3 and 4 are partial perspective views of a graphite body according to another embodiment of the present invention.

FIG. 3 is a partial perspective view of a graphite body 8 according to another embodiment of the present invention. Extended steps 9 are respectively formed at the upper portions of segments 8'. When the segments 8' are arranged to form the graphite body 8, slits are formed beneath the extended steps 9 to have the same width as the extended steps 9. The graphite body 8 as a whole has a columnar shape. In the rotary anode of this embodiment, the extended steps 9 function as spacers, so that the segments cannot be misaligned after hot pressing.

Figure 4:
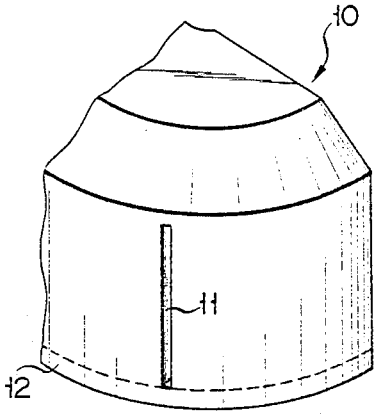

FIG. 4 is a partial perspective view of a graphite body 10 according to still another embodiment of the present invention. A plurality of radial slits 11 are formed in an integrally formed graphite body 10 except at the upper and lower portions thereof. In a subsequent process, a target layer is placed on the graphite body 10 and hot pressing is performed to form an integral body. Thereafter, the lower portion of the integral body is cut away to expose the slits 11 at the lower surface of the graphite body 10.

The rotary anode for an X-ray tube of the above structure according to the present invention may be manufactured as follows.

The target layer can be prepared by the conventional method, so that only a method for manufacturing the graphite body and a method for hot-pressing the graphite body and the target layer is discussed.

First, a method for manufacturing the rotary anode shown in FIGS. 1 and 2 will be described. According to the conventional method, a graphite body 3 is prepared which has a columnar body with a frustoconical tapered surface at its upper portion. In order to form slits of a proper width in the graphite body 3, the graphite body 3 is radially cut by, for example, a diamond cutter, into four segments along two planes which include the rotating shaft. In this embodiment, the graphite body is cut into four segments; however, the number of segments is not limited to four, provided that the thermal stress which occurs between the target layer 2 and the graphite body 3 is within the strength of the final graphite body 3.

After hot-pressing the target layer and the graphite body, and in use of the rotary anode, cracks due to thermal stress may not occur in the graphite body 3.

Figure 5:
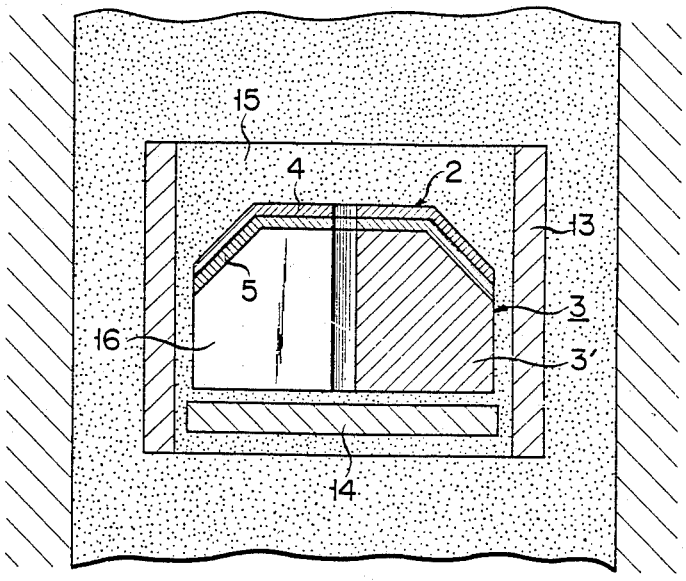
FIG. 5 is a sectional view showing the process of hot pressing.

During hot pressing the segments 3' may be housed in, for example, a cylindrical graphite mold 13 which is placed in the hot press, as shown in FIG. 5. The segments 3' are set in a predetermined shape, and the target layer 2 is adhered to the upper surface of the graphite body 3. At this time, in order to keep the pressure applied to the segments 3' uniform, a thick molybdenum plate 14 is placed under the segments 3'. Furthermore, in order to prevent adhesion between the molybdenum layer 14 and the graphite body 3 and to transmit pressure, refractory ceramic particles 15 such as boron nitride are filled in over the target layer 2 and under the molybdenum plate 14. Furthermore, for forming the slits for reducing the thermal stress, spacers 16 which respectively comprise, for example, ceramic sintered bodies may be sandwiched between the segments 3'. The spacers 16 are eliminated after the target layer 2 has been hot pressed with the graphite body 3.

Furthermore, in the embodiment where the extended steps 9, each of which has a predetermined width, are respectively formed on the upper portions of the segments 8', as shown in FIG. 3, the extended steps 9 function as the spacers. Thus, a gap between adjacent segments 8' is kept constant.

After the segments are set as described above, hot pressing is performed in a reducing atmosphere at a temperature of about 1,400° to 1,600° C. and at a pressure of about 150 to 300 kg/cm$^2$. Therefore, the target layer 2 and the segments 3' are adhered to each other. After the resulting integral body is cooled, the spacers 16 are eliminated to prepare the rotary anode for an X-ray tube as shown in FIGS. 1 and 2.

Furthermore, in the embodiment which uses the graphite body 10 shown in FIG. 4, since the graphite body 10 is not divided by the slits 11 it is readily set in the hot press.

In this embodiment, it is preferable that the refractory ceramic particles are filled into the slits 11 and the cylindrical graphite mold 13 is used in order to apply the pressure uniformly to the graphite body 10.

Figure 6:
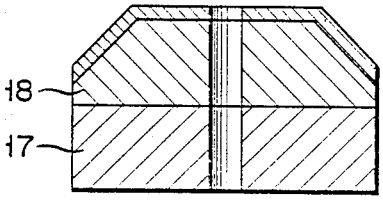
FIG. 6 is a sectional view of a rotary anode according to still another embodiment of the present invention.
Figure 7:
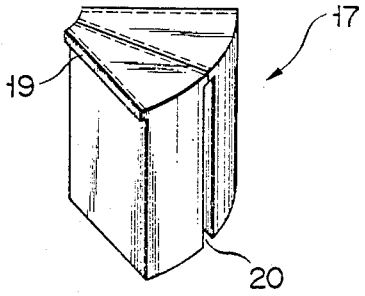
FIG. 7 is a partial perspective view of the graphite body which constitutes the rotary anode shown in FIG. 6.

Furthermore, as shown in FIG. 6, a frustoconical molybdenum body 18 may be formed on a columnar graphite body 17 to make the upper surface of the graphite body 17 flat and to increase the adhesion strength between the molybdenum body 18 and the graphite body 17. In this case, the graphite body 17 may have extended steps 19 thereby forming slits 20 thereunder, as shown in FIG. 7.

What we claim is:

1. A rotary anode for an X-ray tube, comprising a graphite body which has a plurality of radial slits, and a target layer adhered on an upper surface of said graphite body, wherein each of said plurality of slits has a width of about 0.5 to 3 mm.

2. A rotary anode according to claim 1, wherein said target layer comprises a member selected from the group consisting of a single layer of one of tungsten and a tungsten alloy, and a composite layer consisting of said single layer and a molybdenum layer.

3. A rotary anode according to claim 1, wherein said graphite body is divided into a plurality of segments which are separated from each other by said plurality of radial slits.

4. A rotary anode according to claim 1, wherein said plurality of radial slits are formed in said graphite body except at an upper portion thereof, so that said upper portion is continuous.

5. A rotary anode according to claim 1, wherein said graphite body comprises a columnar shape and has a tapered surface at an upper portion.

6. A rotary anode according to claim 1, wherein a volume ratio of said graphite body to said target layer is about 7 to 15:1.

7. A rotary anode according to claim 1, wherein each of said plurality of slits have a width of about 0.6 to 1 mm.

8. A rotary anode according to claim 1, wherein said graphite body has a columnar shape, and said target layer comprises a molybdenum layer which has a frustoconical shape, and a layer which is made of one of tungsten and a tungsten alloy and which is formed on an upper surface of said molybdenum layer.

* * * * *